US011240576B1

(12) United States Patent
Lim et al.

(10) Patent No.: US 11,240,576 B1
(45) Date of Patent: Feb. 1, 2022

(54) DEVICE WITH WATER DRAINAGE FOR A SPEAKER

(71) Applicant: MOTOROLA SOLUTIONS, INC., Chicago, IL (US)

(72) Inventors: Kuang Eng Lim, Bayan Lepas (MY); Sze Yen Lim, Bayan Lepas (MY); Geng Xiang Lee, Bayan Lepas (MY); Ji Ying Choong, Bayan Lepas (MY)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 0 days.

(21) Appl. No.: 17/152,006

(22) Filed: Jan. 19, 2021

(51) Int. Cl.
*H04R 1/02* (2006.01)
*H04R 1/44* (2006.01)

(52) U.S. Cl.
CPC ..... *H04R 1/023* (2013.01); *H04R 1/025* (2013.01); *H04R 1/028* (2013.01); *H04R 1/44* (2013.01); *H04R 2499/11* (2013.01)

(58) Field of Classification Search
CPC ..... H04R 1/023; H04R 1/025; H04R 1/028; H04R 1/44; H04R 2499/11
USPC ..... 381/386
See application file for complete search history.

(56) References Cited

U.S. PATENT DOCUMENTS

| | | | | |
|---|---|---|---|---|
| 10,924,861 | B2 * | 2/2021 | Chen | H04R 7/127 |
| 2004/0264688 | A1 * | 12/2004 | Hampton | H04M 1/03 379/433.02 |
| 2006/0198547 | A1 * | 9/2006 | Hampton | H04R 1/023 381/395 |
| 2015/0319534 | A1 | 11/2015 | Lippert | |
| 2016/0037243 | A1 * | 2/2016 | Lippert | H04R 1/086 381/166 |
| 2016/0150303 | A1 * | 5/2016 | Tan | H04W 4/10 381/334 |
| 2020/0080775 | A1 * | 3/2020 | Argyres | F26B 5/02 |

FOREIGN PATENT DOCUMENTS

| | | | |
|---|---|---|---|
| WO | 2019025885 | A1 | 2/2019 |
| WO | 2020131328 | A1 | 6/2020 |

* cited by examiner

*Primary Examiner* — Sean H Nguyen
(74) *Attorney, Agent, or Firm* — Perry + Currier, Inc.

(57) ABSTRACT

A device with water drainage for a speaker is provided. The device comprises: a housing having a cavity; a speaker mounted in the cavity; a hydrophobic mesh over at least a portion of the cavity, the hydrophobic mesh being air-permeable; a hydrophilic grill adjacent the hydrophobic mesh at a speaker-facing side of the hydrophilic grill, the hydrophilic grill comprising apertures therethrough, the hydrophobic mesh located at least at the apertures; and a bezel covering the hydrophilic grill, one or more of the housing and the bezel including drainage features.

20 Claims, 6 Drawing Sheets

DEVICE WITH WATER DRAINAGE FOR A SPEAKER

BACKGROUND OF THE INVENTION

Some portable devices, such as remote speaker microphones (RSMs), and the like, are often exposed to water, such as rain, water spray, mist and the like, which can get into speaker cavities, and the like, of the portable devices, and block and/or degrade speakers.

BRIEF DESCRIPTION OF THE SEVERAL VIEWS OF THE DRAWINGS

In the accompanying figures similar or the same reference numerals may be repeated to indicate corresponding or analogous elements. These figures, together with the detailed description, below are incorporated in and form part of the specification and serve to further illustrate various embodiments of concepts that include the claimed invention, and to explain various principles and advantages of those embodiments.

Figure 1:
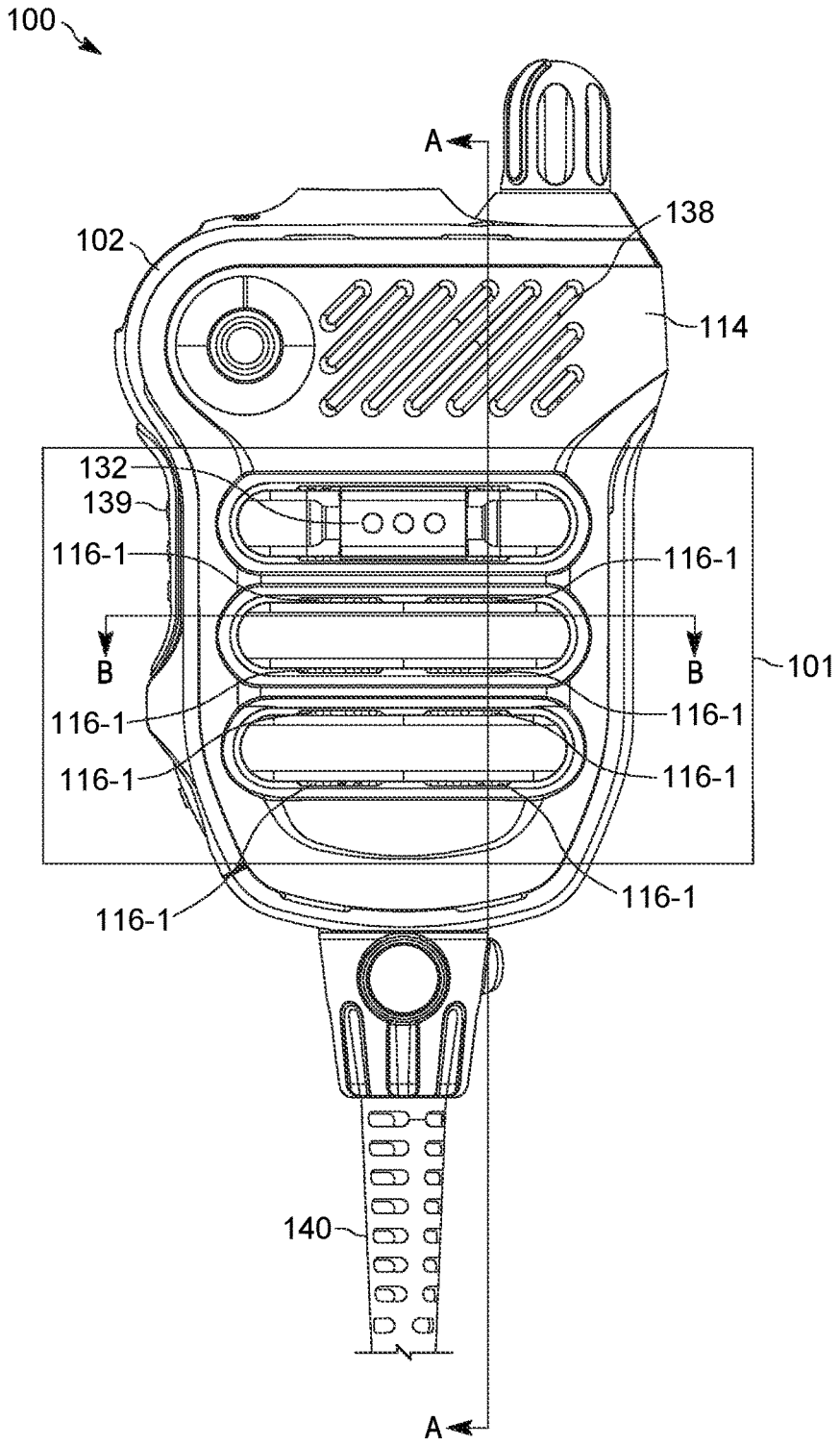
FIG. 1 is a front view of a device with water drainage for a speaker, in accordance with some examples.

Skilled artisans will appreciate that elements in the figures are illustrated for simplicity and clarity and have not necessarily been drawn to scale. For example, the dimensions of some of the elements in the figures may be exaggerated relative to other elements to help improve understanding of embodiments of the present disclosure.

The system, apparatus, and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Some portable devices, such as remote speaker microphones (RSMs), and the like, are often exposed to water, such as rain, water spray, mist and the like, which can get into speaker cavities, and the like, of the portable devices, and block and/or degrade speakers. Similarly, such devices may be exposed to dust and/or ash (e.g. when carried by firefighters, and the like), which may require the device to be rinsed to remove the dust and/or ash, again exposing the device to water and blocking and/or degrading speakers. Such blockage and/or degradation can cause the speakers to operate poorly, which may cause unintelligible speech at the device (e.g. from a speaker). Thus, there exists a need for an improved device with water drainage for a speaker.

Hence, provided herein is a device that includes a hydrophobic mesh, such as a monofilament-based technical fabric, that covers a speaker cavity, with a hydrophilic grill adjacent the mesh, and a bezel covering the hydrophilic grill. Water that enters the device, for example through various apertures and/or speaker ports in the bezel, and the like, is generally repelled by the hydrophobic mesh and/or wicked away from the hydrophobic mesh via apertures of the hydrophilic grill via capillary action; furthermore air pressure from a speaker in the speaker cavity, combined with the capillary action, may generate a total outward force on the water, moving the water away from the hydrophobic mesh, towards the hydrophilic grill. The bezel may be close enough to the hydrophilic grill that the water is further wicked away from the hydrophilic grill to between the bezel and the hydrophilic grill; the water may then drain through drainage features in the bezel, such as the speaker ports, and/or the water may collect and run in a downward direction, towards drainage features in a housing of the device, such as channels, presuming the device may "normally" be operated in an upright direction, with the channels located in the downward direction and/or at a bottom of the housing.

An aspect of the specification provides a device comprising: a housing having a cavity; a speaker mounted in the cavity; a hydrophobic mesh over at least a portion of the cavity, the hydrophobic mesh being air-permeable; a hydrophilic grill adjacent the hydrophobic mesh at a speaker-facing side of the hydrophilic grill, the hydrophilic grill comprising apertures therethrough, the hydrophobic mesh located at least at the apertures; and a bezel covering the hydrophilic grill, one or more of the housing and the bezel including drainage features.

Another aspect of the specification provides a portable communication device comprising: a housing having a cavity; a speaker mounted in the cavity; a hydrophobic mesh over at least a portion of the cavity, the hydrophobic mesh being air-permeable; a hydrophilic grill adjacent the hydrophobic mesh at a speaker-facing side of the, hydrophilic grill, the hydrophilic grill comprising apertures therethrough, the hydrophobic mesh located at least at the apertures; a bezel covering the hydrophilic grill, one or more of the housing and the bezel including drainage features; a microphone located in the housing, the bezel further covering the microphone; and a communication link to a transceiver, the speaker and the microphone connected to the transceiver via the communication link.

Each of the above-mentioned embodiments will be discussed in more detail below, starting with example system and device architectures of the system in which the embodiments may be practiced, followed by an illustration of processing blocks for achieving an improved device with water drainage for a speaker.

Example embodiments are herein described with reference computer program instructions which may be provided to a processor of a general purpose computer, special purpose computer, or other programmable data processing apparatus to produce a special purpose and unique machine, such that the instructions, which execute via the processor of the computer or other programmable data processing apparatus, create means for implementing the functions/acts described herein. These computer program instructions may also be stored in a computer-readable memory that can direct a computer or other programmable data processing apparatus to function in a particular manner, such that the instructions stored in the computer-readable memory produce an article of manufacture including instructions, which implement the functions/acts described herein. The computer program instructions may also be loaded onto a computer or other programmable data processing apparatus that may be on or off-premises, or may be accessed via the cloud in any of a software as a service (SaaS), platform as a service (PaaS), or infrastructure as a service (IaaS) architecture so as to cause a series of operational blocks to be performed on the computer or other programmable apparatus to produce a computer implemented process such that the instructions, which execute on the computer or other programmable apparatus provide blocks for implementing the functions/acts described herein. It is contemplated that any part of any aspect or embodiment discussed in this specification can be implemented or combined with any part of any other aspect or embodiment discussed in this specification.

Further advantages and features consistent with this disclosure will be set forth in the following detailed description, with reference to the figures.

Herein, the terms water and moisture are generally used interchangeably, such that "moisture" may refer to "water" and vice versa; hence, properties of various materials and/or components are described herein as being hydrophobic or hydrophilic, which are understood to, respectively, repel or attract water and/or moisture.

Attention is directed to FIG. 1 which depicts a front view of a device 100 with water drainage for a speaker, in accordance with some examples. As depicted the device 100 comprises a remote speaker microphone (and/or a radio speaker microphone), however the device 100 may comprise any suitable device and/or portable communication device with water drainage for a speaker, as described hereafter. In some examples, the device 100 may comprise a body wearable device, such as the depicted remote speaker microphone, and/or another body wearable device. In particular examples, the device 100 may comprise a shoulder mountable wearable device (such as a shoulder mountable RSM and/or another shoulder mountable wearable device).

However, the device 100 may include any suitable device that includes a speaker in a cavity that may be adapted to include water drainage for the speaker, as described hereafter, including, but not limited to, portable device, a cell phone, a radio device, a laptop computer, and the like and/or a non-portable device.

The device 100 will next be described in more detail with further reference to FIG. 1, as well as FIG. 2, FIG. 3, and FIG. 4.

Figure 2:
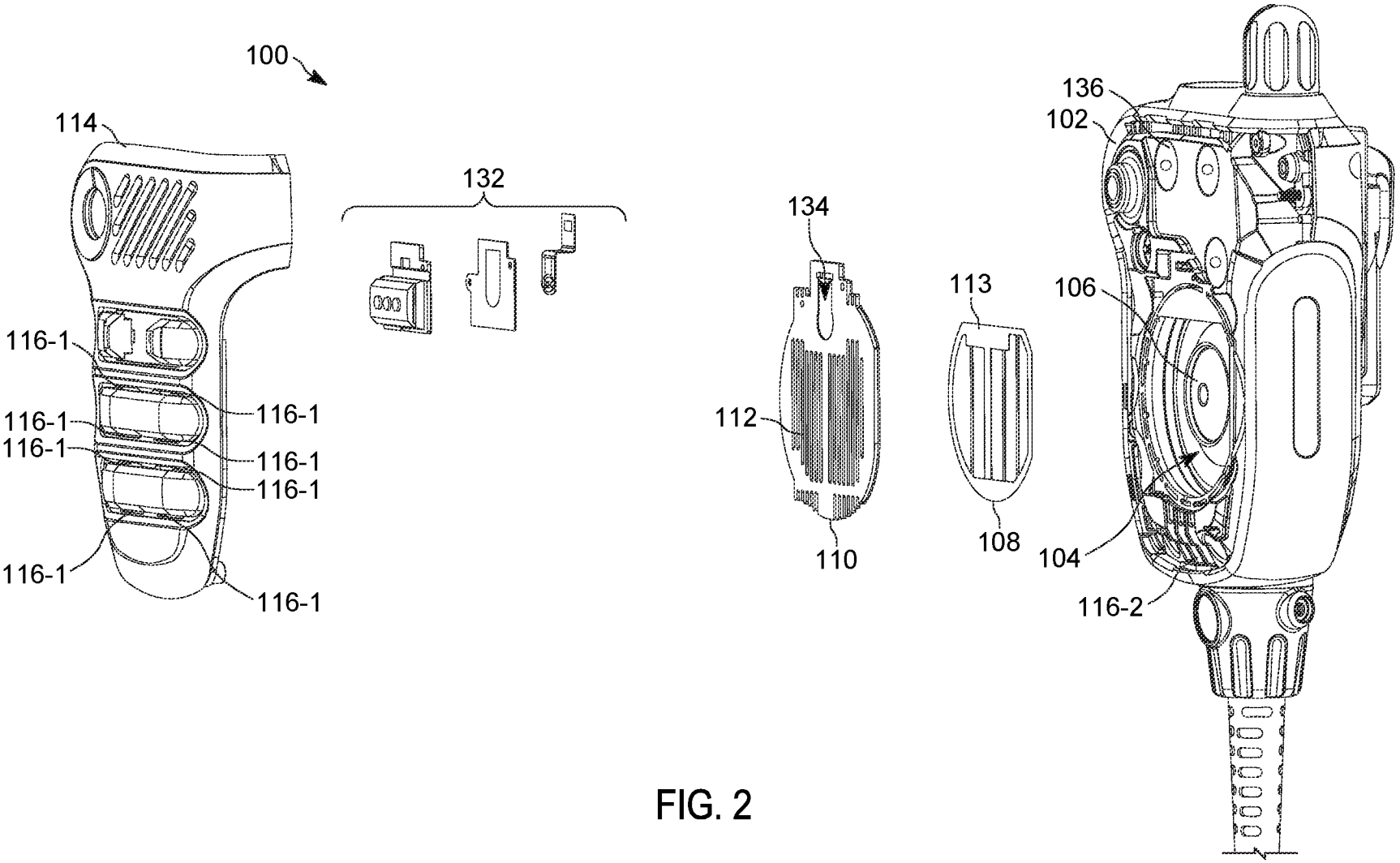
FIG. 2 depicts a perspective of an exploded view of the device of FIG. 1, in accordance with some examples.

With reference to FIG. 1 and FIG. 2, the device 100 generally comprises a housing 102 and, as best seen in FIG. 2, the housing 102 includes a cavity 104; a speaker 106 is generally mounted in the cavity 104. While as depicted the cavity 104 is circular, the cavity 104 may be any suitable shape.

As also best seen in FIG. 2, the device 100 further comprises a hydrophobic mesh 108 over at least a portion of the cavity 104, the hydrophobic mesh being air-permeable. In some examples, the hydrophobic mesh 108 may comprises one or more of a monofilament-based technical fabric, polyvinyl coated polyester (PES), and the like. The hydrophobic mesh 108 may comprise mesh apertures having a size of between about 20 microns and about 300 microns. However, the hydrophobic mesh 108 may comprise any suitable hydrophobic material in the form of a mesh, and the like, which is air-permeable with any suitable size of apertures therein.

In particular, the hydrophobic mesh 108 may have a wettability corresponding to values of angle of contact (e.g. of water) that may be one or more of: greater than about 90° (degrees); and between about 120° and about 180°. In a particular example, the contact angle may be about 140°. However, the hydrophobic mesh 108 may have any suitable wettability that results in the hydrophobic mesh 108 being generally water repellent and/or hydrophobic.

The device 100 further comprises a hydrophilic grill 110, adjacent the hydrophobic mesh 108 at a speaker-facing side of the hydrophilic grill 110 (e.g. in FIG. 2, the speaker-facing side of the hydrophilic grill 110 is opposite a depicted bezel-facing side). The hydrophilic grill 110 generally comprises apertures 112 therethrough, and the hydrophobic mesh 108 is generally located at least at the apertures 112. For example, the hydrophobic mesh 108 may be one or more of attached and bonded to the hydrophilic grill 110 at the speaker-facing side of the hydrophilic grill 110 using any suitable adhesive, and the like. Indeed, in FIG. 2, regions 113 of the hydrophobic mesh 108 which are not at the apertures 112, when the hydrophobic mesh 108 is attached to the hydrophilic grill 110, show where such an adhesive may be applied. However, hydrophobic mesh 108 need not be attached to the hydrophilic grill 110; rather the hydrophobic mesh 108 and the hydrophilic grill 110 may reside adjacent to each other.

The hydrophilic grill 110 may comprises one or more steel and stainless steel having a thickness in a range of about 0.5 mm to about 1 mm, and the apertures 112 may comprise slots having a width between about 0.6 mm to about 1.5 mm, and a length of between about 15 mm and about 40 mm. However, the hydrophilic grill 110 may comprise any suitable hydrophilic material (e.g. other than steel) with any suitable size of apertures 112 therein, in any suitable shape. For example, rather than slots, the apertures 112 may comprise circular holes and/or any other suitably shaped hole.

In particular, the hydrophilic grill 110 may have a wettability corresponding to values of angle of contact that may be one or more of: less than about 60° (degrees); and between about 30° and about 40°. However, the hydrophilic grill 110 may have any suitable wettability that results in the hydrophilic grill 110 generally attracting water and/or being hydrophilic.

Hence, as will be described below, moisture that penetrates the device 100 may generally be stopped by the hydrophobic mesh 108 and/or may collect on the hydrophobic mesh 108, for example, in the apertures 112; and, as the hydrophobic mesh 108 repels water, and walls of the adjacent apertures 112 attract water (e.g. due to the material of the hydrophilic grill 110 hydrophilic), the moisture at the hydrophobic mesh 108 may generally be drawn away from the hydrophobic mesh 108 by the hydrophilic grill 110.

The device 100 further comprises a bezel 114 covering the hydrophilic grill 110. For example, the bezel 114 may be formed from a polycarbonate material. and/or any other suitable material and may be hydrophobic or hydrophilic. Furthermore, together, the housing 102 and the bezel 114 may form a remote speaker microphone that contains other features of the device 100 as described herein; for example, the bezel 114 may removably mate with the housing 102 via any suitable combination of fasteners (e.g. snaps, clips, and the like). The remote speaker microphone may be used to conduct calls via the device 100, including, but not limited to, voice calls via communication networks (e.g. as described below with respect to FIG. 6), push-to-talk calls, and the like, and/or activate other functionality such receive voice commands, transmit location notifications, and the like, and/or any other suitable functionality.

In general, one or more of the housing 102 and the bezel 114 includes drainage features 116-1, 116-2 (interchangeably referred to hereafter, collectively, as drainage features 116 and, generically, as a drainage feature 116). For example, drainage features 116-1 of the bezel 114 may include ports, such as speaker ports, and the like, through the bezel 114, such that moisture that collects at the hydrophilic grill 110 wicks to the bezel 114, due to capillary action, and through the ports, and drains out of the device 100. Hence the drainage features 116-1 may act as path for sound from the speaker 106 to exit the device 100, as well as a path for moisture to enter and exit the device 100.

Figure 3:
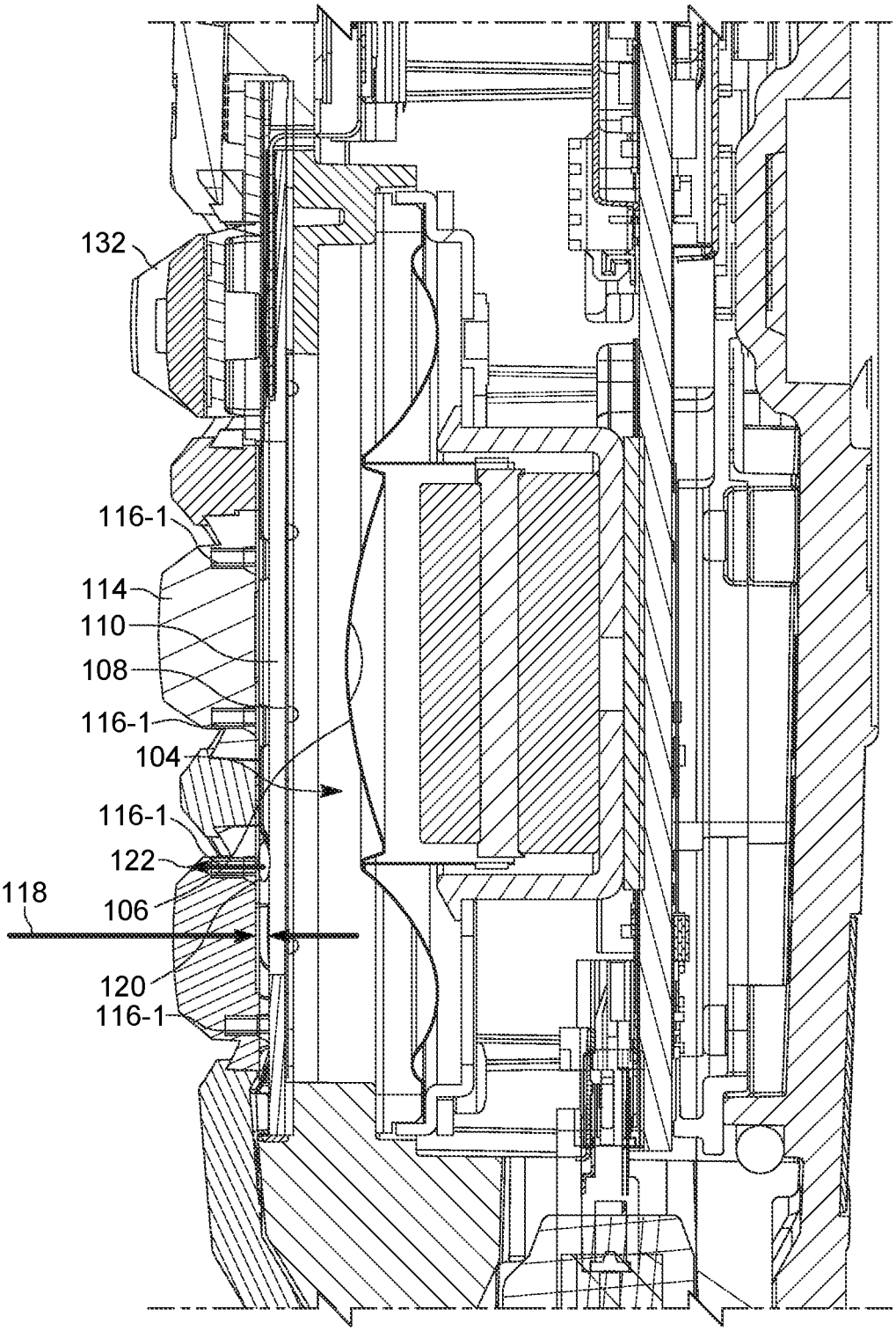
FIG. 3 depicts a cross-section of a portion the device of FIG. 1 through a line A-A shown in FIG. 1, in accordance with some examples.

With reference to FIG. 3, which depicts a cross-section of the region 101 of the device 100 through the line A-A, the bezel 114 may be located at a distance 118 from a bezel-facing side of the hydrophilic grill 110 such that moisture 120 (e.g. as depicted, a water droplet) that collects between the bezel 114 and the hydrophilic grill 110 wicks to the bezel 114 due to capillary action, and through the ports of the drainage features 116-1, as represented by an arrow 122.

In particular, as has been described, the moisture 120 may collect in the apertures 112 of the hydrophilic grill 110. Being repelled by the hydrophobic mesh 108, the moisture 120 may further wick away from the hydrophobic mesh 108 to the apertures 112 due to capillary action, as well as the general hydrophobic nature of the hydrophobic mesh 108 in combination with the general hydrophilic nature of the hydrophilic grill 110. As such, the size and/or shape of the apertures 112 may be selected accordingly to promote such capillary action.

Similarly, the distance 118 between the bezel 114 and the hydrophilic grill 110, as well as a size and/or shape of the ports of the drainage features 116-1, may be selected to promote capillary action from the apertures 112 to the ports of the drainage features 116-1 such that the moisture 120 is wicked through the ports of the drainage features 116-1 and out of the device 100. In some examples, the distance 118 between the bezel 114 and the hydrophilic grill 110 may be in a range of about 0.2 mm to about 1.0 mm; in a particular example, the distance 118 between the bezel 114 and the hydrophilic grill 110 may be about 0.5 mm.

Put another way, the bezel 114 may be spaced from the hydrophilic grill 110 at a distance 118 selected to wick the moisture 120 away from one or more of the hydrophilic grill 110 and the apertures 112 due to capillary action.

Furthermore, while the apertures 112 are not seen in FIG. 2, comparing FIG. 1, FIG. 2 and FIG. 3, the apertures 112 of the hydrophilic grill 110 may comprise slots (e.g. as has already been described), and the drainage features 116-1 may comprise elongate ports (e.g. elongate speaker ports) through the bezel 114 about perpendicular to the slots. However, the shape and/or size and/or configuration of the apertures 112 and the drainage features 116-1 may be any suitable values.

Figure 4:
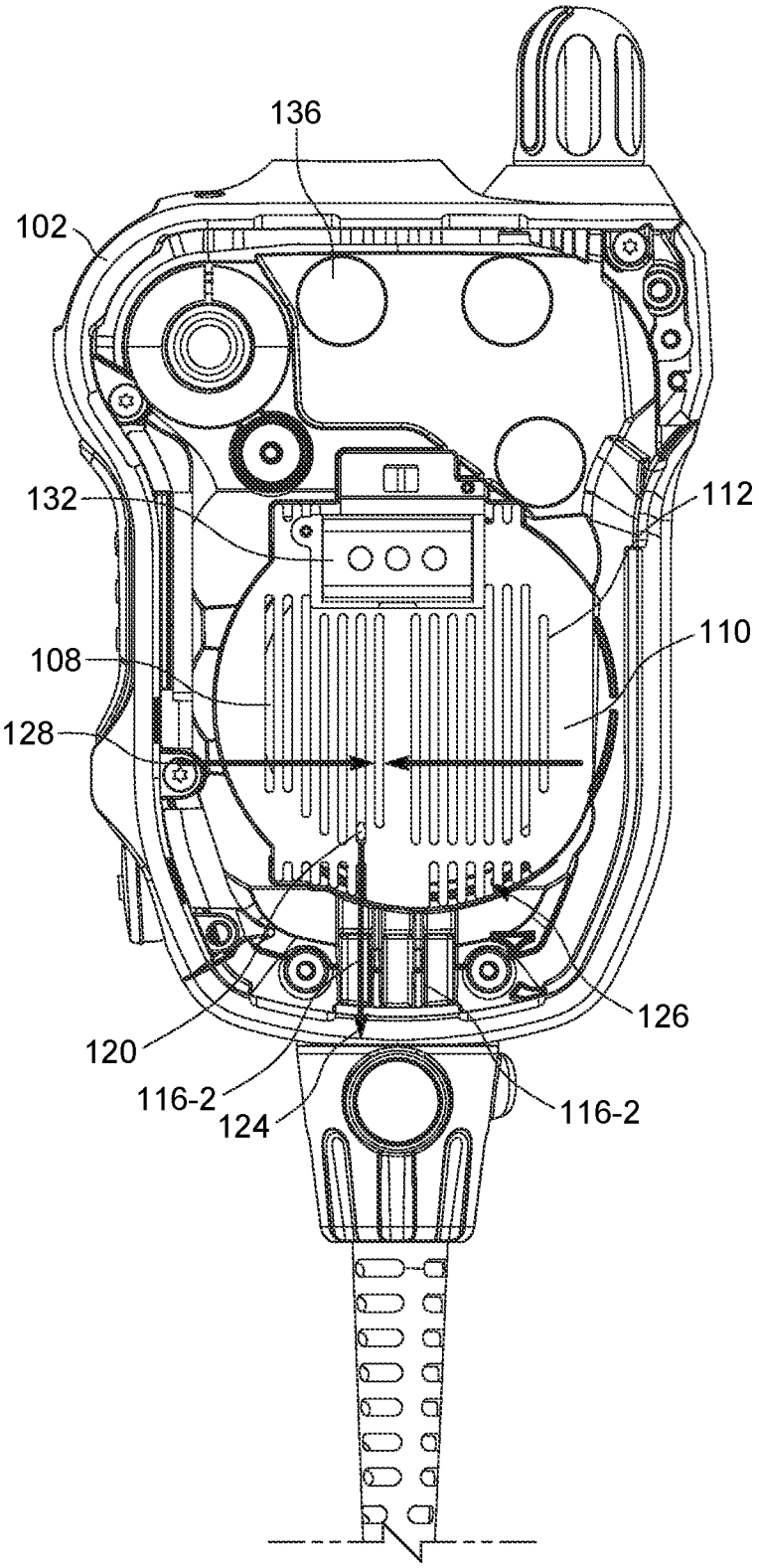
FIG. 4 depicts a front view of the device of FIG. 1 with a bezel removed, in accordance with some examples.

Similarly, with reference to FIG. 2 and FIG. 4, the drainage features 116-2 of the housing 102 may comprise channels in the housing 102 such that moisture that collects at one or more of the hydrophilic grill 110 and the apertures 112 runs towards the channels and drains out of the device 100. In these examples, with reference to FIG. 4, which depicts a front view of the device 100 with the bezel 114 removed, the device 100 and/or the housing 102 may be configured to be operated in an upright direction (e.g. with respect to the ground). For example, in FIG. 4, the device 100 is understood to be upright; hence, as depicted, the channels of the drainage features 116-2 of the housing 102 are in a downward direction, such that the moisture 120 that collects at one or more of the hydrophilic grill 110 and the apertures 112 runs in the downward direction through the channels, as represented in FIG. 4 by an arrow 124, which are hence understood to be located at a bottom end of the housing 102.

Put another way, the housing 102 and/or the device 100 may be configured to for operation in an upright direction, and the drainage features 116-2 may comprise channels in the housing 102 in a downward direction, such that the moisture 120 that collects at one or more of the hydrophilic grill 110 and the apertures 112 runs in the downward direction through the channels.

As is further apparent in FIG. 4, when the housing 102 is configured for operation in an upright direction, and the apertures 112 of the hydrophilic grill 110 comprises slots, such slots may be about parallel to the upright direction, for example to promote movement of the moisture 120 at and/or in the hydrophilic grill 110 towards the channels of the drainage features 116-2 of the housing 102. Similarly, as has already been described, the drainage features 116-2 may comprise channels in the housing 102 in a downward direction, such that the moisture 120, which collects at one or more of the hydrophilic grill 110 and the slots, runs in the downward direction through the channels.

As depicted, fins 126, and the like, may extend in a downward direction from a bottom of the hydrophilic grill 110; the fins 126 may promote movement of the moisture 120 along the hydrophilic grill 110 towards the channels of the drainage features 116-2 of the housing 102.

While, as depicted, the channels of the drainage features 116-2 of the housing 102 may be located in a downward direction (e.g. relative to the hydrophilic grill 110 and the apertures 112, when the device 100 and/or the housing 102 is in an upright position), the housing 102 may include channels and/or other suitable types of drainage features 116-2, in any direction relative to the hydrophilic grill 110 and the apertures 112. For example, the housing 102 may include channels and/or other suitable types of drainage features 116-2 at sides thereof, such that when the device 100 and/or the housing 102 is rotated 90° (e.g. relative to the position shown in FIG. 4), the moisture 120 may run outwards through such channels and/or other suitable types of drainage features 116-2. Similarly the housing 102 may include channels and/or other suitable types of drainage features 116-2 at a top end thereof, such that when the device 100 and/or the housing 102 is rotated 180° (e.g. relative to the position shown in FIG. 4), the moisture 120 may run outwards through such channels and/or other suitable types of drainage features 116-2.

As also best seen in FIG. 4, the apertures 112 and/or the slots thereof may comprise a width 128 selected to wick the moisture 120 away from the hydrophobic mesh 108 due to capillary action, as described below with respect to FIG. 5.

In particular, a thicknesses of the hydrophilic grill 110 may be further selected in combination with selection of the width 128 of the apertures 112, and/or slots, such that water droplets (e.g. such as the moisture 120) form at, and/or between, opposing sides of the apertures 112. For example, a capillary effect in a space may depend on a cross-sectional area of a space; hence the thicknesses of the hydrophilic grill 110 and the width 128 of the apertures 112 may be selected such that an area of the apertures 112 (e.g. about the value of a thicknesses of the hydrophilic grill 110, multiplied by a respective value for the width 128 of the apertures 112) induces formation of water droplets, for example from side to side across an aperture 112.

In a particular example, the slots of the apertures 112 may be about 0.8 mm wide and around about 25 mm long. Furthermore, the slots of the apertures 112 may be different lengths, for example to accommodate the shape of the cavity 104 (e.g. which, as depicted, may be generally circular) and/or other features of the device 100 (e.g. such as a button, described in more detail below). While as depicted there are fifteen slots of the apertures 112, there may be any suitable number of slots and/or apertures 112. Hence, in this particular example, a total opening area of the slots of the apertures 112 may be about 300 $mm^2$, which may be changed and/or tuned and/or selected to provide a minimal mass inertance of air in the ports of the drainage features 116-1, which generally also act as speaker ports, to increase output from the speaker 106. However, the dimensions of the slots and/or the apertures 112 (e.g. including, but not limited to, a total opening area) may be any suitable values compatible with both a general size and shape of the device 100 and/or the speaker 106, etc., as well as the capillary action described herein.

A capillary effect may hold water droplets in an aperture 112 until the capillary effect of the distance 118 wicks the water droplets out of an aperture 112 and through a drainage feature 116-1 (e.g. as depicted in FIG. 3) and/or until a weight thereof breaks the water surface tension and water from the water droplets flows towards the drainage features 116-2 (e.g. as depicted in FIG. 4), for example due to gravitational pull and/or further capillary action. Such formation of water droplets and/or flow of water (e.g. due to gravitational pull and/or capillary action) may further be affected by a materials (e.g. and/or a wettability thereof) that form the hydrophobic mesh 108, the hydrophilic grill 110 and/or the bezel 114. Hence, dimensions of components provided herein may be further selected in combination with selection of a materials thereof.

Hence, various mechanisms for drainage are provided. Furthermore, when the ports of the drainage features 116-1 through the bezel 114 are present, drainage of moisture 120 out of device 100 does not depend on the device 100 being held in a particular direction due to the capillary action described with respect to FIG. 3.

Figure 5:
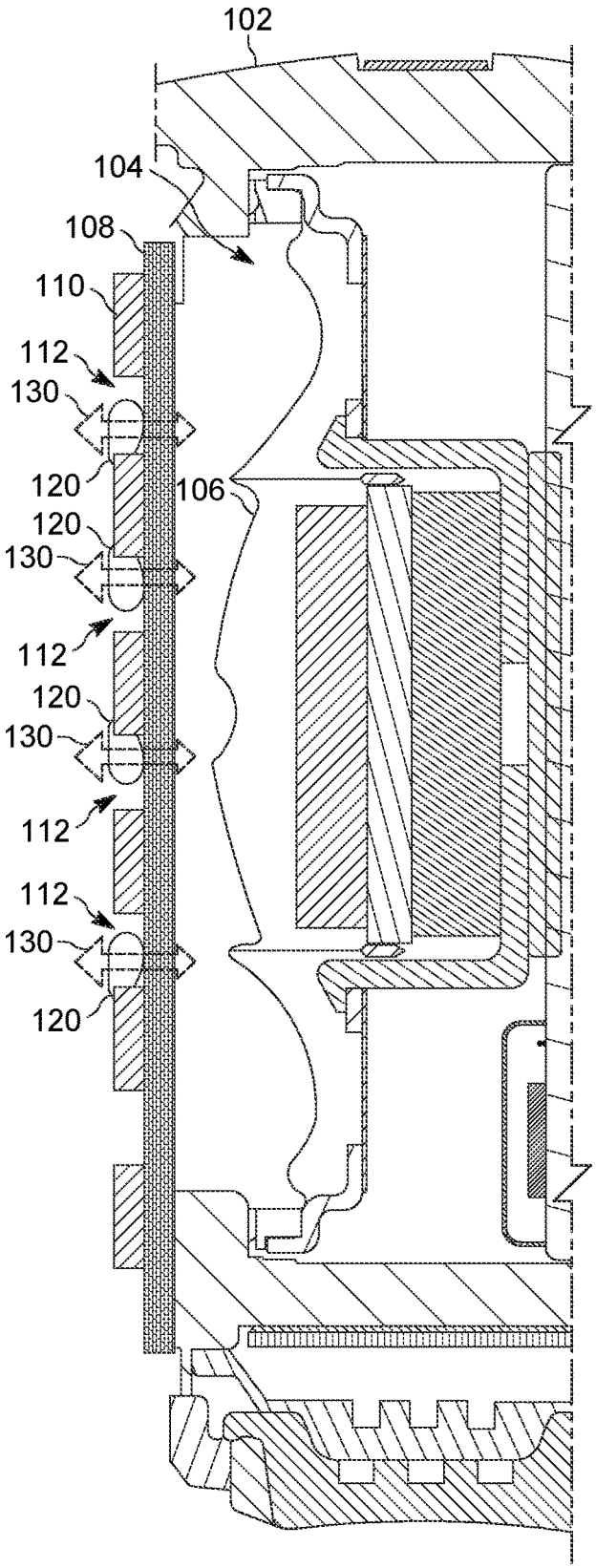
FIG. 5 depicts a block diagram of a cross-section of the device of FIG. 1 through a line B-B shown in FIG. 1, with a bezel removed. in accordance with some examples.

However, operation of the speaker 106 may also assist with drainage of the moisture 120 out of the device 100, as is next described with respect to FIG. 5, which depicts a block diagram of a cross-section through a line B-B shown in FIG. 1, with the bezel 114 removed. In FIG. 5 it is understood that the hydrophobic mesh 108, the hydrophilic grill 110, and the apertures 112 are not shown exactly and/or to scale; rather FIG. 5 is provided to illustrate the movement of the moisture 120 due to capillary action in combination with movement of air due to operation of the speaker 106.

As depicted, the moisture 120 in the form of water droplets is depicted in various apertures 112, the moisture 120 located at the hydrophobic mesh 108 and at sides of the apertures 112 of the hydrophilic grill 110. A contact angle of the moisture 120 at the hydrophobic mesh 108 is depicted as greater than 90°, while a contact angle of the moisture 120 at the sides of the apertures 112 of the hydrophilic grill 110 is depicted as less than 60°. Furthermore, the moisture 120 is depicted as flowing to a bezel-facing side of the hydrophilic grill 110. In other words, capillary action, in combination with the hydrophobicity of the hydrophobic mesh 108 and the hydrophilicity of the hydrophilic grill 110, is generally causing the moisture 120 to wick out of the apertures 112.

Furthermore, the speaker 106 is understood to vibrate when sound is produced, which generates pressure waves in air in the cavity 104, which move out, and in, through the apertures 112. While such movement may also move the moisture 120 out of, and back into, the apertures 112, the force of the pressure waves, combined with the aforementioned capillary action, generally has a net effect of moving the moisture 120 out of the apertures 112, for example as represented by arrows 130. Each arrow 130 shows a larger head out of an aperture 112, away from the hydrophobic mesh 108, and a smaller head towards the hydrophobic mesh 108. The larger head of the arrows, out of an apertures 112, represents a combined force of pressure and capillary action on the moisture 120 away from the hydrophobic mesh 108, for example when the speaker 106 is pushing air out of the cavity 104; and the smaller head represents a force of pressure on the moisture 120 towards the hydrophobic mesh 108, for example when the speaker 106 is pulling air into the cavity 104.

Hence, the arrows 130 generally represents a larger force on the moisture 120 out of the apertures 112, away from the hydrophobic mesh 108, as compared to towards the hydrophobic mesh 108.

Put another way, the speaker 106 may be operated such that movement of air through the apertures 112 of the hydrophilic grill 110, in combination with capillary action between the apertures 112 of the hydrophilic grill 110 and the hydrophobic mesh 108, causes a net force on the moisture 120 that collects in the apertures 112 that is away from the hydrophobic mesh 108. For example, loudness and/or a minimum operating volume of the speaker 106 may be set such that movement of air through the apertures 112 of the hydrophilic grill 110, in combination with capillary action between the apertures 112 of the hydrophilic grill 110 and the hydrophobic mesh 108, causes a net force on the moisture 120 that collects in the apertures 112 that is away from the hydrophobic mesh 108. While not depicted, such a minimum volume of the speaker 106 may be provided in computer program instructions, and the like as implemented by a processor which is driving the speaker 106, which, while not depicted, may be present at the device 100 and/or a device with which the device 100 is in communication (e.g. the device 600 as described in more detail below with respect to FIG. 6).

Furthermore, comparing FIG. 5 and FIG. 3, the moisture 120 may be further wicked away from the hydrophilic grill 110 towards the bezel 114 (e.g. via the distance 118), and out of the drainage features 116-1, as has already been described.

Similarly, comparing FIG. 5 and FIG. 4, the moisture 120 may collect in the apertures 112 and/or a bezel-facing side of the hydrophilic grill 110 and run towards, and out of, the drainage features 116-2, as has already been described.

The device 100 may generally comprise any other suitable features. For example, with reference again to FIG. 1 and FIG. 2, the device 100 may further (optionally) comprise a button 132, which may be assigned any suitable functionality including, but not limited to, indicating that a voice command is to be received at a microphone of the device 100 (e.g. via microphones 136, described in more detail below), answering and/or ending a call and/or a voice call, transmitting a location notification and the like. In some examples, functionality of the button 132 (e.g. when present) may be programmable.

As best seen in FIG. 2, the button 132, in an exploded view, comprises various features for biasing and/or actuating the button 132 (e.g. such as spring, a switch, and the like). As also best seen in FIG. 2, as depicted, the hydrophilic grill 110 may comprises an aperture-free region 134 behind the button 132, which may also include a spring and the like, and may assist with the biasing and/or actuating of the button 132. Hence, a configuration and/or sizes and/or shapes of the apertures 112 may be adapted to accommodate the region 134 and/or the button 132.

Again with reference to FIG. 1 and FIG. 2, the device 100 may further comprise a microphone and/or microphones 136, for example located behind a corresponding grill 138 in the bezel 114.

In a particular example, the button 132 may be assigned voice command and/or voice control functionality and hence may alternatively be referred to as the voice-control button 132. It is further understood that the device 100 may comprise other buttons in other locations at the housing 102, and the like, for example, a push-to-talk button 139 at a side of the housing 102 as best seen in FIG. 1, for use in controlling push-to-talk calls when the device 100 is a remote-speaker microphone (e.g. using the speaker 106 and the microphones 136). As such, in these specific examples, the device 100 is understood to be a remote speaker microphone (RSM) with a push-to-talk button 139 on a side of the housing 102 and the voice-control button 132 on a front of the housing 102 (and/or a front of the bezel 114), and the hydrophilic grill 110 comprises the aperture-free region 134 behind the voice command button 132.

The device 100 may further comprise a communication link 140 to a transceiver, the speaker 106 and the microphone(s) 136 connected to the transceiver via the communication link 140.

Figure 6:
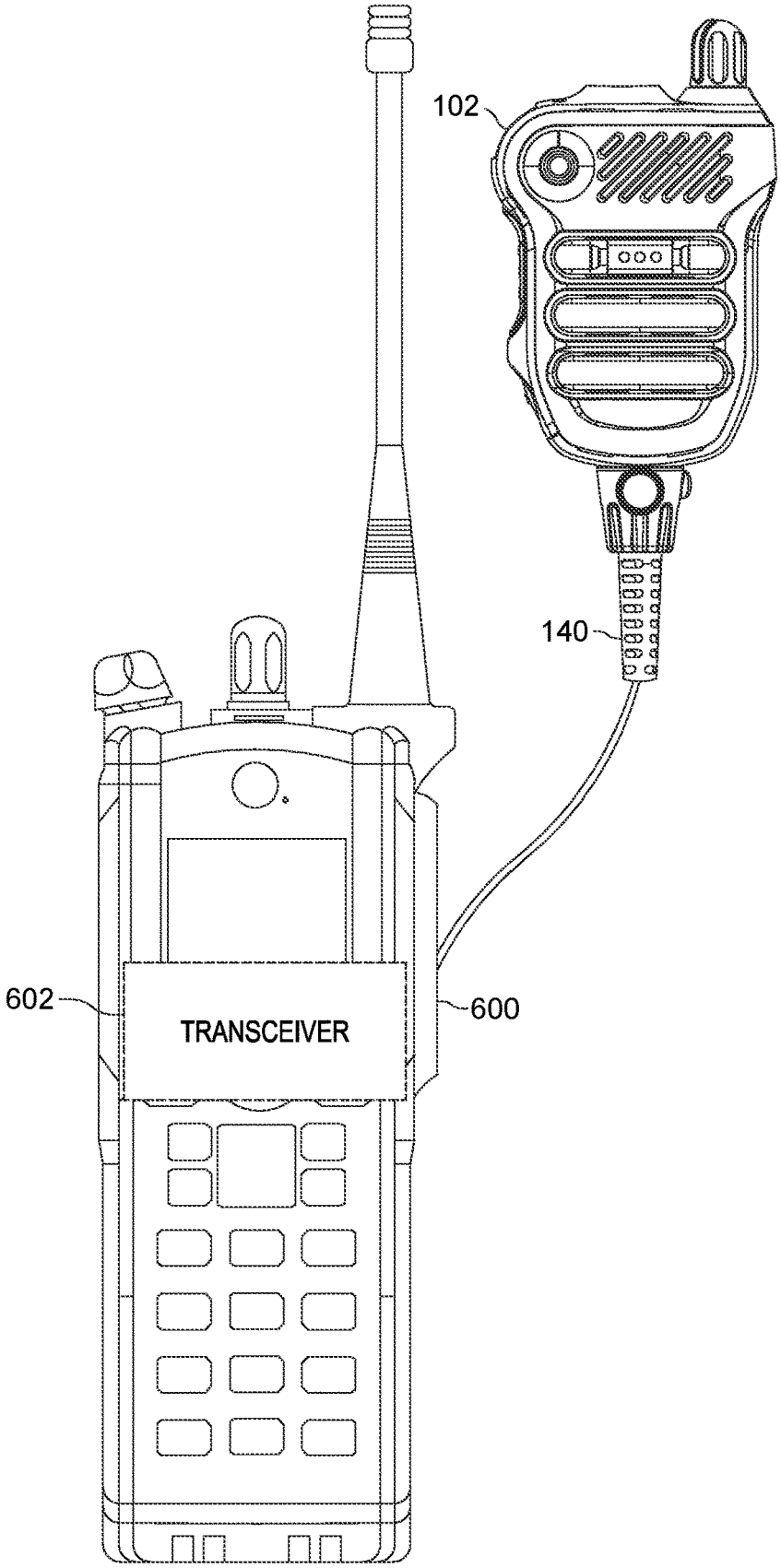
FIG. 6 depicts a portable communication device that incorporates the device of FIG. 1, in accordance with some examples.

For example, with reference to FIG. 6, the device 100 may be a component of a portable communication device 600 (interchangeably referred to herein as the device 600), that includes a transceiver 602. In FIG. 6, the transceiver 602 is depicted in broken lines indicating that the transceiver 602 is located internal to the device 600. As depicted, the device 600 comprises a portable radio, and the device 100 comprises an RSM of the device 600, though the devices 100, 600 may comprise any suitable portable device and/or component thereof. The device 600 in combination with the device 100 may hence be used to conduct calls via the transceiver 602, including, but not limited to, voice calls, push-to-talk calls, and the like. Furthermore, the device 600 may comprise a location determining device, such as a Global Positioning System (GPS) device, and the like. The button 132 may be programmed (e.g. via computer program instructions stored at the device 600 and/or the device 100) to implement functionality at the device 600, when actuated, including but not limited to indicating that a voice command is to be received at a microphone 136 of the device 100 (e.g. and which may be implemented at the device 600 and/or the device 100), answering and/or ending a call and/or a voice call, transmitting a location notification (e.g. to a location server, the location notification comprising a location determined by a location determining device), and/or any other suitable functionality.

As depicted, the communication link 140 comprise a wired communication link with the transceiver 602; however, in other examples, the communication link 140 may be wireless.

Regardless, the device 600 is understood to include the device 100, including the communication link 140 to the transceiver 602, with the speaker 106 and the microphone(s) 136 connected to the transceiver 602 via the communication link 140.

Hence, the device 100 and/or the device 600 is generally configured to provide water drainage for a speaker thereof.

As should be apparent from this detailed description above, the operations and functions of the devices described herein are sufficiently complex as to require their implementation on a computer system, and cannot be performed, as a practical matter, in the human mind. Electronic computing devices such as set forth herein are understood as requiring and providing speed and accuracy and complexity management that are not obtainable by human mental steps, in addition to the inherently digital nature of such operations (e.g., a human mind cannot interface directly with RAM or other digital storage, cannot transmit or receive electronic messages, electronically encoded video, electronically encoded audio, etc., and cannot operate a speaker such that movement of air through apertures of a hydrophilic grill, in combination with capillary action between the apertures of the hydrophilic grill and an adjacent hydrophobic mesh, causes a net force on moisture that collects in the apertures that is away from the hydrophobic mesh, among other features and functions set forth herein).

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "one of", without a more limiting modifier such as "only one of", and when applied herein to two or more subsequently defined options such as "one of A and B" should be construed to mean an existence of any one of the options in the list alone (e.g., A alone or B alone) or any combination of two or more of the options in the list (e.g., A and B together).

Similarly, in this document, language of "at least one of X, Y, and Z" and "one or more of X, Y and Z" may be construed as X only, Y only, Z only, or any combination of two or more items X, Y, and Z (e.g., XYZ, XY, YZ, XZ, and the like). Similar logic may be applied for two or more items in any occurrence of "at least one . . . " and "one or more . . . " language.

A device or structure that is "configured" in a certain way is configured in at least that way, but may also be configured in ways that are not listed.

The terms "coupled", "coupling" or "connected" as used herein can have several different meanings depending on the context in which these terms are used. For example, the terms coupled, coupling, or connected can have a mechanical or electrical connotation. For example, as used herein, the terms coupled, coupling, or connected can indicate that two elements or devices are directly connected to one another or connected to one another through intermediate elements or devices via an electrical element, electrical signal or a mechanical element depending on the particular context.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Any suitable computer-usable or computer readable medium may be utilized. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. In the context of this document, a computer-usable or computer-readable medium may be any medium that can contain, store, communicate, propagate, or transport the program for use by or in connection with the instruction execution system, apparatus, or device.

Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation. For example, computer program code for carrying out operations of various example embodiments may be written in an object oriented programming language such as Java, Smalltalk, C++, Python, or the like. However, the computer program code for carrying out operations of various example embodiments may also be written in conventional procedural programming languages, such as the "C" programming language or similar programming languages. The program code may execute entirely on a computer, partly on the computer, as a stand-alone software package, partly on the computer and partly on a remote computer or server or entirely on the remote computer or server. In the latter scenario, the remote computer or server may be connected to the computer through a local area network (LAN) or a wide area network (WAN), or the connection may be made to an external computer (for example, through the Internet using an Internet Service Provider).

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A device comprising:

a housing having a cavity;

a speaker mounted in the cavity;

a hydrophobic mesh over at least a portion of the cavity, the hydrophobic mesh being air-permeable;

a hydrophilic grill adjacent the hydrophobic mesh at a speaker-facing side of the hydrophilic grill, the hydrophilic grill comprising apertures therethrough, the hydrophobic mesh located at least at the apertures; and a bezel covering the hydrophilic grill, one or more of the housing and the bezel including drainage features.

2. The device of claim 1, wherein the apertures comprise slots with a width selected to wick moisture away from the hydrophobic mesh due to capillary action.

3. The device of claim 1, wherein the bezel is spaced from the hydrophilic grill at a distance selected to wick moisture away from one or more of the hydrophilic grill and the apertures due to capillary action.

4. The device of claim 1, wherein the drainage features comprise ports through the bezel such that moisture that collects at the hydrophilic grill wicks to the bezel, due to capillary action, and through the ports.

5. The device of claim 4, wherein the apertures of the hydrophilic grill comprise slots, and the drainage features comprise elongate ports through the bezel about perpendicular to the slots.

6. The device of claim 1, wherein the housing is configured to be operated in an upright direction, and the drainage features comprise channels in the housing in a downward direction, such that moisture, that collects at one or more of the hydrophilic grill and the apertures, runs in the downward direction through the channels.

7. The device of claim 1, wherein the housing is configured to be operated in an upright direction, and the apertures of the hydrophilic grill comprises slots about parallel to the upright direction.

8. The device of claim 7, wherein the drainage features comprise channels in the housing in a downward direction, such that moisture, which collects at one or more of the hydrophilic grill and the slots, runs in the downward direction through the channels.

9. The device of claim 1, wherein the hydrophobic mesh comprises one or more of a monofilament-based technical fabric and polyvinyl coated polyester (PES), comprising mesh apertures having a size of between about 20 microns and about 300 microns.

10. The device of claim 1, wherein the hydrophilic grill comprises one or more steel and stainless steel having a thickness in a range of about 0.5 mm to about 1 mm, and the apertures comprise slots having a width between about 0.6 mm to about 1.5 mm, and a length of between about 15 mm and about 40 mm.

11. The device of claim 1, wherein the hydrophobic mesh is one or more of attached and bonded to the hydrophilic grill at the speaker-facing side of the hydrophilic grill.

12. The device of claim 1, wherein the hydrophilic grill has a wettability corresponding to values of angle of contact that is one or more of: less than about 60° (degrees); and between about 30° and about 40°.

13. The device of claim 1, wherein the speaker is operated such that movement of air through the apertures of the hydrophilic grill, in combination with capillary action between the apertures of the hydrophilic grill and the hydrophobic mesh, causes a net force on moisture that collects in the apertures that is away from the hydrophobic mesh.

14. The device of claim 13, wherein the bezel further comprises a button, and the hydrophilic grill comprises an aperture-free region behind the button.

15. The device of claim 1, wherein the device is a remote speaker microphone (RSM) with a push-to-talk button on a side of the housing and a voice-control button on a front of the housing, and the hydrophilic grill comprises an aperture-free region behind the voice command button.

16. A portable communication device comprising:

a housing having a cavity;

a speaker mounted in the cavity;

a hydrophobic mesh over at least a portion of the cavity, the hydrophobic mesh being air-permeable;

a hydrophilic grill adjacent the hydrophobic mesh at a speaker-facing side of the, hydrophilic grill, the hydrophilic grill comprising apertures therethrough, the hydrophobic mesh located at least at the apertures;

a bezel covering the hydrophilic grill, one or more of the housing and the bezel including drainage features;

a microphone located in the housing, the bezel further covering the microphone; and a communication link to a transceiver, the speaker and the microphone connected to the transceiver via the communication link.

17. The portable communication device of claim 16, wherein the apertures comprise slots with a width selected to wick moisture away from the hydrophobic mesh due to capillary action.

18. The portable communication device of claim 16, wherein the bezel is spaced from the hydrophilic grill at a distance selected to wick moisture away from one or more of the hydrophilic grill and the apertures due to capillary action.

19. The portable communication device of claim 16, wherein the drainage features comprise ports through the bezel such that moisture that collects at the hydrophilic grill wicks to the bezel, due to capillary action, and through the ports.

20. The portable communication device of claim 16, wherein the housing and the bezel form a remote speaker microphone.

* * * * *